United States Patent [19]

Eichbaum et al.

[11] 4,354,670

[45] Oct. 19, 1982

[54] LINING APPARATUS FOR METALLURGICAL VESSELS, PARTICULARLY FOR STEEL MILL CONVERTERS AND/OR BLAST FURNACES

[75] Inventors: Gerhard Eichbaum; Wolfgang Heidemann, both of Duisburg, Fed. Rep. of Germany

[73] Assignee: Mannesmann DeMag A.G., Duisburg, Fed. Rep. of Germany

[21] Appl. No.: 153,896

[22] Filed: May 28, 1980

[30] Foreign Application Priority Data

May 28, 1979 [DE] Fed. Rep. of Germany ..... 2921538

[51] Int. Cl.[3] ..... C21B 7/04

[52] U.S. Cl. ..... 266/281; 198/812; 414/10

[58] Field of Search ..... 266/281, 287; 198/801, 198/812; 414/10

[56] References Cited

U.S. PATENT DOCUMENTS

| | | | |
|---|---|---|---|
| 3,352,406 | 11/1967 | Long | 198/812 |
| 3,506,105 | 4/1970 | Stauber | 198/812 |
| 3,935,941 | 2/1976 | Keck | 198/812 |
| 3,955,685 | 5/1976 | Smith | 214/1 H |
| 4,033,463 | 7/1977 | Cervin | 198/801 |
| 4,231,470 | 11/1980 | Parkes | 198/812 |

FOREIGN PATENT DOCUMENTS

| | | |
|---|---|---|
| 2914651 | 3/1979 | Fed. Rep. of Germany . |
| 1533903 | 8/1979 | Fed. Rep. of Germany . |
| 2908170 | 10/1979 | Fed. Rep. of Germany . |

*Primary Examiner*—John P. Sheehan

*Attorney, Agent, or Firm*—Mandeville and Schweitzer

[57] ABSTRACT

The invention refers to a brick lining apparatus for metallurgical vessels, particularly for steel mill converters and/or blast furnaces, with an annular working platform which is automatically adjustable in height, and with a coordinated brick conveyor line consisting of one or several chains leading around sprocket wheel pairs with attached brick supports, whereby working platform and brick conveyor line are retractable to approximately the distance between mill floor and vessel opening.

15 Claims, 4 Drawing Figures

12b
12c
15
8
13
14
2
2a
11
10
11a
(11b)
11c
1
1b
1a
8
3a
3c
4b
35
37
19
I
I
18
36
36a
11c
22
21
20
4
16
17
31
30
29
8
25
24
23
11d
28
27
26
6
7
9
16a
12a
4a
5
5

LINING APPARATUS FOR METALLURGICAL VESSELS, PARTICULARLY FOR STEEL MILL CONVERTERS AND/OR BLAST FURNACES

BACKGROUND AND SUMMARY OF THE INVENTION

This type of apparatus serves to facilitate the delivery work in metallurgical vessels, to reduce the delivery time, and to increase the lining capacity. These requirements can only be met by means of a continuous transport flow of the bricks via horizontal and vertical brick conveyor lines. Furthermore, through automation of the brick transport there is to be a saving in workmen and/or workmen are to be freed for work on the platform.

DE-OS No. 15 33 903 discloses an annular work platform which is automatically adjustable in height, whereby the work platform is retractable to approximately the distance between mill floor and vessel bottom opening. Here, the vertical brick conveyor line consists of an elevator cabin conveying the bricks in loads to the working platform.

According to the older unpublished DE patent application No. P 29 14 651.8, it has been suggested to form a vertical brick conveyor line by attaching brick supports to one or several chains leading around sprocket wheel pairs. The chains together with their brick support plates are arranged, by means of guide elements attached to a frame in pairs, in the form of a chain storage extending horizontally in the area of the lower sprocket wheel storage rack. Furthermore, the chain storage extending horizontally may also be connected to the vehicle carrying the lining apparatus.

When using infinite chains leading around sprocket wheels pairs, the lining apparatus for metallurgical vessels, particularly for steel mill converters and/or blast furnaces has the disadvantage of great heights in the conveying of bricks. Another problem of such lining apparatus results from the method of operation in metallurgical vessels of placing rows of bricks progressively from bottom to top. This method of operation requires intermittent adjusting in height of the work platform which does not present any problem due to the use of telescope hoisting elements, however, it does present a problem in view of the vertical brick conveyor line, to which so far no solution has been found.

It is the object of the invention to adjust vertical brick conveyor lines formed by chains for lining apparatuses of metallurgical vessels with automatically height-adjustable working platforms to the constantly varying heights.

The invention solves this problem by leading infinite parallel pairs of chains, designed for a maximum brick conveying height, during their run-off course around several pairs of coaxial sprocket wheels, by arranging the sprocket wheel pairs at the minimum distance of their diameters or further removed from each other, their axles resting on a frame, whereby two neighboring sprocket wheel pairs each are coordinated with a sprocket wheel pair with a movable axle arranged in a guide, adjustable in the sense of a reduction or increase in the length of the storage at a distance to the neighboring sprocket wheel pairs, and whereby the brick supports are attached to the chains from the outside or from the inside circumventing the sprocket wheel diameters of a sprocket wheel pair. Such a design has the advantage of regulating the vertical length of the vertical brick conveying line depending upon the respective level of the working platform, although the brick supports present an obstacle when using a chain storage.

The invention provides that the brick supports are essentially arranged between the sprocket wheels of a sprocket wheel pair. Such spatial division (distribution) does not interfere in particular with the presence of the brick supports in the chain storage.

The distance of the coordinated sprocket wheels in the sense of a shortening or lengthening of the useful length of chain (vertical brick conveyor line) may be varied so that the movably arranged axles of the adjustable sprocket wheels are provided with traction elements, e.g. weights, tension springs, or the thrust rod of a straight motion drive whose housing may be flexibly hinged, if required.

The capacity of the chain storage as per invention may also be increased. To this end it is suggested that the adjacent sprocket wheel pairs, arranged in a row, and situated so that their axles are displaceable in a common guide.

The axles of the coaxial sprocket wheel pairs may also be moved in a straight line, whereby the common guide, according to another improvement of the invention, consists of a straight rail guide.

The arrangement of the chain storage within the lining apparatus may, depending upon the distance betwen the mill floor and the vessel opening, be such that the adjacent and/or opposite sprocket wheels forming the chain storage, together with the chain, form a meander shape extending horizontally or vertically.

With regard to the horizontal plane, the lining apparatuses in general are limited with respect to their interior surface due to the telescope screw jacks carrying the lift platform. It is therefore advantageous if, according to another improvement of the invention, the sprocket wheels forming the chain storage are arranged in a space between opposite telescope screw jacks for the annular working platform which is adjustable in height.

Furthermore provision is made that all sprocket wheels are seated in a frame which is separate from the frame for the lining apparatus.

Finally, it is suggested in addition to a separate chain storage that the frame for the sprocket wheels may be taken out of the frame of the lining apparaus. Thus, the invention makes possible a subsequent installation into existing lining apparatuses built up on several telescope screw jacks.

An example of the invention is shown on the drawing and explained as follows:

DETAILED DESCRIPTION OF THE INVENTION

Figure 1:
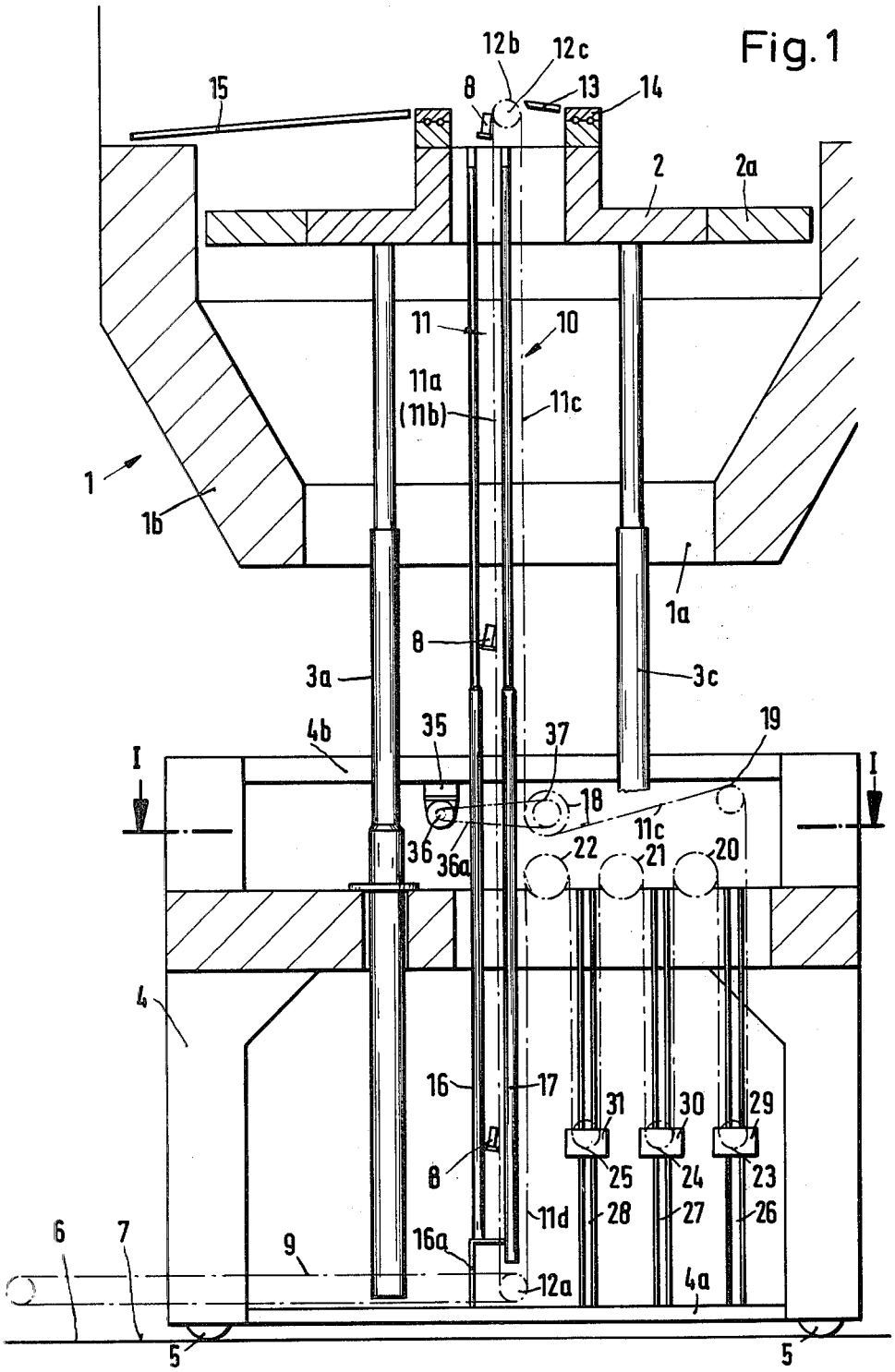
FIG. 1 is a vertical cross section through the lining apparatus as per invention with the vessel to be lined.
Figure 2:
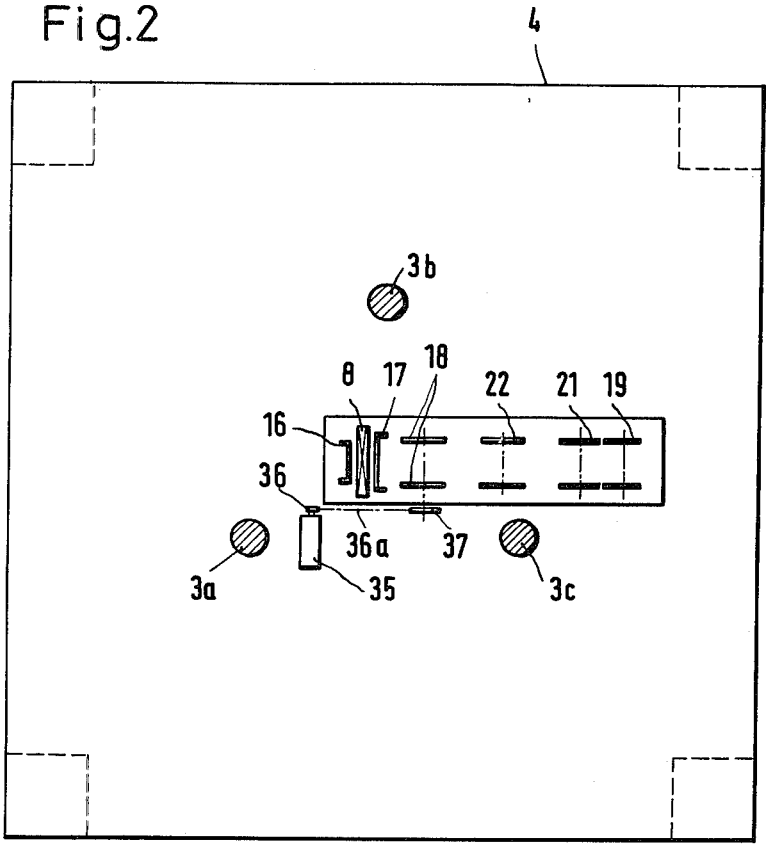
FIG. 2 is a horizontal cross section according to line I—I in FIG. 1.

The lining apparatus is shown in use for steel mill converter 1 (FIG. 1). The annular working platform 2 whose work surface may be increased from the reduced vessel opening diameter 1*a* to the diameter 1*b* by means of adjustable elements 2*a*, is supported by the hydraulically operated telescope screw jacks 3*a*, 3*b*, and 3*c*. The frame 4 carries the telescope screw jacks 3*a* through 3*c* and travels on wheels 5 on rails 6 at the level of the mill floor 7.

The fireproof (refractory) bricks 8 required for the lining 1*b* are transferred via the horizontal brick conveyor line 9 to the vertical brick conveyor line 10. The latter consists of a chain pair 11 whose individual chains 11*a*, 11*b* lead around the sprocket wheel pairs 12*a*, 12*b*. The bricks 8 delivered to the level of the working platform 2 are brought "overhead" to the slide 13, the rotary table 14, and the roller table 15 to be placed on to the lowest layer of the lining 1*b*.

The chains 11*a*, 11*b* are stretched to the desired vertical length via the telescope guides 16 and 17 which are attached to the frame bottom part 4*a* via a mount 16*a*. The reel-off course 11*c* leads around a guide (deflector) sprocket wheel 18 and a further guide sprocket wheel 19, both pivoting on their axles in the frame 4. Further sprocket wheel pairs 20, 21, 22 rest with their axles in a horizontal and parallel position. Between two each of the neighboring sprocket wheel pairs 20 through 22 there are additional sprocket wheels pairs 23, 24, 25 whose axles slide in vertical guides 26, 27, and 28. Traction elements 29, 30, 31 are attached to the axles of the movable sprocket wheel pairs 23, 24, and 25. The former may also consist of tension springs attached to the bottom part of the frame 4*a*, or of straight motion drives whose piston rods (presupporting hydraulic piston-cylinder drives) are controlled accordingly.

The reel-off course 11*c* leads (FIG. 1) from the guide sprocket wheel pair 19 via the sprocket wheel pairs 23, 20, 24, 21, 25, 22 and from there turns into the reel-on course 11*d*.

Figure 3:
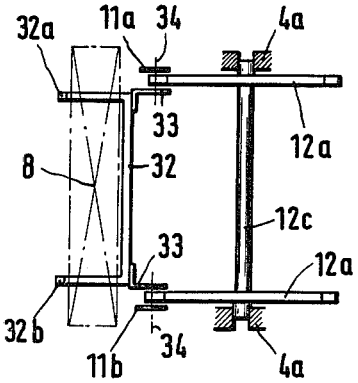
FIG. 3 is a detail of the attachment of the brick supports to the chains, in plan view, enlarged.
Figure 4:
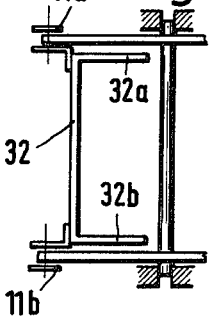
FIG. 4 is a detail of the position of the brick supports at the inner passage of the sprocket wheel pairs, enlarged as FIG. 3.

The brick supports 32 are attached to chain pairs 11*a*, 11*b* (FIG. 3). The brick supports 32 each form a U-shaped yoke which is, in its corners, attached by means of pairs of angle braces 33 to the bolts 34 joining the chain links or to the chain links themselves. There are two possibilities for attachment:

The yokes 32 may either be connected between the two wheels 12*a* of a sprocket wheel pair (FIG. 3) to the chain bolts 34 and/or to the chain links. The other method of attachment is on the outside to the chain bolt 34 and/or to the outer chain links. In both methods the diameters of the sprocket wheels are kept free and/or are circumvented for the engagement and/or disengagement of the chains. Furthermore, it is to be noted that the sprocket wheels pairs 12*a*, 12*b* which are circumvented by the brick supports 32 on the outside, may have a relatively smaller diameter. The sprocket wheel pairs 18, 20, 21, 22 are circumvented on the inside (FIG. 4) and their diameter must be such that the legs 32*a* and 32*b* of the brick supports 32, matching the various brick widths, do not touch the axle (12*c*) of a sprocket wheel pair. Therefore, the diameter of the sprocket wheel pairs 18, 20, 21, 22 is greater than that of the sprocket wheel pairs 12*a*, 12*b*, 19, 23, 24 and 25.

The chain pair 11*a*, 11*b* (FIGS. 3 and 4) is put into motion by means of the drive motor 35 located at the top part of the frame 4*b*, by means of the sprocket wheel 36, chain 36*a*, and drive sprocket wheel 37 which is fixed on the axle of the guide sprocket wheel 18. The brick supports 32 maintain their position with regard to the chains 11*a*, 11*b*.

We claim:

1. A lining apparatus for metallurgical vessels having an upper portion and a lower portion, said lower portion having a bottom opening spaced above a mill floor, which apparatus comprises (a) a working platform, (b) platform elevator means for supporting said platform above the mill floor and varying its height between selected positions within the vessel and a position beneath the bottom opening of the vessel, (c) a generally horizontally extending brick conveyor line, (d) a generally vertically extending brick conveyor line for transporting bricks from below the vessel to the working platform, (e) the length of said horizontally extending brick conveying means being independent of the height of said vertically extending brick conveying means, (f) said vertical conveyor line comprising endless chain means supported by a plurality of sprocket wheel means including upper sprocket wheel means, lower sprocket wheel means, reel-off sprocket wheel means including at least one storage sprocket wheel means, (g) sprocket wheel support means supporting said sprocket wheel means in a predetermined configuration together with said chain means defining (1) a vertical brick delivery course extending from said lower to said upper delivery sprocket wheel means, (2) a reel-off course extending from said upper delivery sprocket wheel means, said reel-off course including at least three reel-off course sprocket wheel means, (3) a reel-on course extending from the last of said reel-off course sprocket wheel means to said lower delivery sprocket wheel means, (h) means for varying the length of said vertical brick delivery course by varying the separation of said upper and lower delivery sprocket wheel means, the height of said vertical brick delivery course being adapted to be coordinated with the height of said working platform, (i) said at least one storage sprocket wheel means being positioned in opposed relationship with two sprocket wheel means, (j) guide means supporting at least one of said storage sprocket wheel means or said opposed sprocket wheel means for limited predetermined displacement to vary the distance between said storage sprocket wheel means and the opposed sprocket wheel means selectively to increase and to decrease the length of chain in the reel-off course and corresponding selectively to decrease and to increase the height of the brick delivery course, (k) brick support means attached to the chain means in a manner whereby said brick support means clear the sprocket wheel means.

2. The lining apparatus according to claim 1, wherein (a) said chain means comprises parallel pairs of infinite chains and (b) said sprocket wheel means comprise pairs of coaxial sprocket wheels.

3. The lining apparatus according to claim 1, further comprising (a) additional storage sprocket wheel means, each of which is positioned in opposed relationship to two sprocket wheel means which support said chain means, (b) said additional storage sprocket wheel being located along said chain means between said two sprocket wheel means.

4. The lining apparatus according to claim 1, wherein (a) the axle of said storage sprocket wheel means is positioned movably in a guide and (b) the axles of said two opposed sprocket wheel means rest in a stationary position on a frame.

5. The lining apparatus according to claim 2, wherein (a) said brick support means clears a sprocket wheel pair by passing along the inside of said sprocket wheel pair, and (b) the legs of said brick support being short enough to avoid the axle of said sprocket wheel pair.

6. The lining apparatus according to claim 4, further comprising (a) traction means which are attached to the displaceable axles of the storage sprocket wheel means.

7. Lining apparatus according to claim 6, wherein said traction means comprise a weight, a tension spring or the piston rod of a straight motion drive.

8. Lining apparatus according to claim 3, wherein the axles of said storage sprocket wheel means are parallel and are movably positioned in a common guide.

9. Lining apparatus according to claim 1, wherein the guide means comprises a straight rail guide.

10. Lining apparatus according to claim 1, wherein the storage sprocket wheel means and the opposed sprocket wheel means together with the chain means extend in a meander shape horizontally or vertically.

11. Lining apparatus according to claim 1, wherein (a) said platform elevator means comprises opposite telescope screw jacks, and (b) the sprocket wheels forming the chain storage course are arranged in a space between opposite telescope screw jacks.

12. Lining apparatus according to claim 1, further comprising (a) a platform elevator frame for said platform elevator means and (b) said sprocket wheel support means comprising a sprocket wheel frame which supports all of the sprocket wheel means and is separate from said platform elevator frame.

13. Lining apparatus according to claim 12, wherein the sprocket wheel frame is removable from the platform elevator frame.

14. Lining apparatus according to claims 1, 3, 8 or 12 wherein said two sprocket wheel means are adjacent to each other and are separated by at least the length of the diameter of one of said two sprocket wheel means.

15. Lining apparatus according to claim 14, wherein said storage sprocket wheel means is positioned along the median plane between the two opposed sprocket wheel means.

* * * * *